United States Patent [19]

Smith et al.

[11] Patent Number: 4,703,586

[45] Date of Patent: Nov. 3, 1987

[54] DOOR SEALING MECHANSIM

[76] Inventors: Derek Smith, 10 High View Road, Douglas, Isle of Man; David Seed, 24 Nuttall Street, Blackburn, Lancashire, United Kingdom

[21] Appl. No.: 783,497

[22] Filed: Oct. 3, 1985 (Under 37 CFR 1.47)

[51] Int. Cl.[4] ..... E06B 7/20

[52] U.S. Cl. ..... 49/307; 49/308; 49/303

[58] Field of Search ..... 49/303, 306–309, 49/321, 478, 409, 410, 404

[56] References Cited

U.S. PATENT DOCUMENTS 1,751,526 3/1930 Neilsen ..... 49/307
3,346,993 10/1967 Johnson ..... 49/409
4,575,966 3/1986 Gerritsen ..... 49/404 X

FOREIGN PATENT DOCUMENTS 2509958 9/1976 Fed. Rep. of Germany ..... 49/306

*Primary Examiner*—Kenneth Downey
*Attorney, Agent, or Firm*—Neal J. Mosely

[57] ABSTRACT

A mechanism for automatically blocking the gap between the bottom edge of a door leaf, hung to open and close within a surrounding frame, and the adjacent threshold, when the door is closed; and automatically unblocking that gap when the door starts to open again, comprises an elongate bar housed above a strip of material in the bottom edge region of the door leaf. The bar and strip of material each are coupled to respective attraction/repulsion elements. One element is a magnet and the other is a piece of material having a positive reaction to a magnet, typically a further magnet. One end of the bar or an auxiliary member coupled to the bar protrudes from an edge of the door adjacent the door frame. The arrangement is such that, with the door open, the strip of material is raised clear of the adjacent threshold. As the door closes, the protruding end of the bar or auxiliary member contacts the upright of the door frame and is moved longitudinally to take the two sets of magnets out of line with one another and to allow—or to positively repulse—the strip of material to fall and block the gap between the bottom edge of the door leaf and the adjacent threshold.

11 Claims, 10 Drawing Figures

Fig.1.
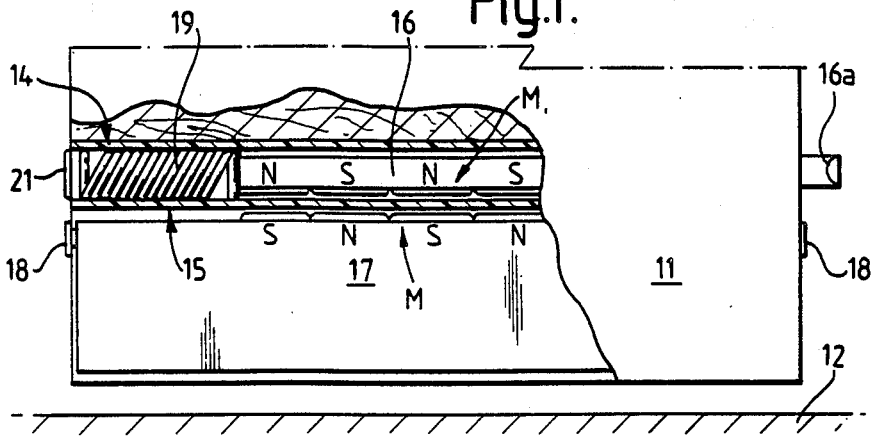
Fig.2.
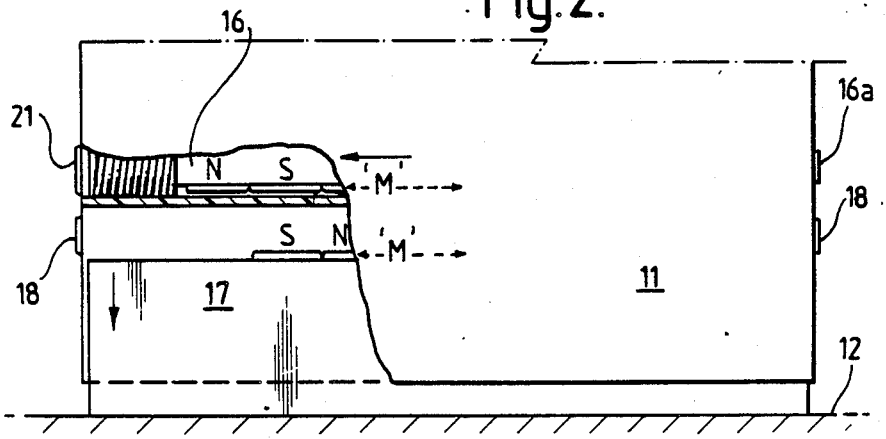
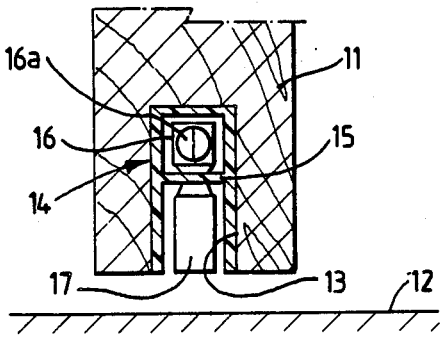
Fig.3.

DOOR SEALING MECHANSIM

FIELD OF THE INVENTION

The invention relates to a mechanism for sealing or at least blocking the gap between the bottom edge of a hung and openable and closable door leaf and the adjacent threshold.

REVIEW OF THE PRIOR ART

Draft excluders which fix directly along the bottom edge region of a door are known. They comprise strips of material which extend along essentially the whole of the length of the bottom edge of the door leaf. Although they can flex relative to the door leaf they do not otherwise move in relation to it. For this reason they have drawbacks in that they rub against the surrounding carpet or other floor covering, causing wear, and making it difficult to open and close the door without effort to overcome the frictional resistance of the strip against the carpet.

Lever-action draft excluders are known in which the draft excluding strip is automatically raised from the carpet as the door swings about its hinges, and is progressively lowered into place as the door closes. These are not wholly reliable and are expensive and relatively complicated to fit to the door leaf.

Neither of the known general forms of sealing or blocking strip just outlined has been specifically developed as a fire-resistant sealing strip.

SUMMARY OF THE INVENTION

The present invention seeks to provide a means for automatically blocking off the gap along the bottom edge of the door leaf when the door is closed, and unblocking that gap as the door opens, which is without the drawbacks of known sealing strips and which can be adapted to form a fire-resistant strip.

In its broadest aspect the invention provides a mechanism for attachment to a door leaf, hung within a surrounding frame to open and close an adjacent threshold, the door leaf having a bottom face having an elongate edge and a short end edge; a gap being defined between the bottom face of the door leaf and the surrounding frame when the door is closed; the mechanism for automatically blocking said gap when the door is closed; and automatically unblocking said gap when the door subsequently starts to open; the mechanism comprising:

(a) a strip of material having a length essentially equal to the length of the elongate edge of the bottom face of the door leaf;

(b) housing means housing said strip in the region of the bottom face of the door leaf to extend along the elongate edge of the door leaf;

(c) means mounting said strip within said housing means for movement up and down from a first position (in which said strip protrudes from the bottom face of the door leaf to contact the threshold); into and out of a second position (in which it is held clear of the threshold);

(d) a strip actuation member including an elongate bar and actuation means;

(e) means mounting said elongate bar within said strip housing means to extend adjacent said strip, for movement back and forth along a horizontal axis;

(f) means mounting said actuation means adjacent one of the threshold and an upright of the door frame, for movement between a first and second position;

(g) a first attraction/repulsion element;

(h) a second attraction/repulsion element;

(i) one of said attraction/repulsion elements comprising at least one magnet; and the other of said attraction/repulsion elements comprising at least one piece of material having a positive reaction of one of attraction or repulsion to the magnet;

(j) means fixing said first attraction/repulsion element on said elongate bar;

(k) means mounting said second attraction/repulsion element within said housing means for movement up and down, in the vicinity of the first attraction/-repulsion element;

(l) means operatively coupling said second attraction/repulsion element to said strip whereby movement in the vertical direction of the second attraction/repulsion element causes movement in the vertical direction of said strip;

(m) press means;

(n) means mounting said press means to one of the threshold and an upright of the door frame to cooperate with said actuation means, whereby to move said actuation means from second position when the door is open to a first position when the door is closed; and, (o) means connecting said actuation means to said elongate bar whereby movement of said actuation means causes movement along said axis of said elongate bar and said first attraction/repulsion element with respect to said second attraction/-repulsion element;

the arrangement whereby the first attraction/repulsion element is moved from a position in which it is within the range of the second attraction/repulsion element and said positive reaction between said magnet and said piece of material occurs to a position where the first attraction/repulsion element is out of the range of the second attraction/repulsion element and said reaction is absent; whereby on closure of said door, said actuation means moves to said first position to move said elongate bar to move the first attraction/repulsion element with respect to the second attraction/repulsion element to cause vertical movement of the second attraction/-repulsion movement to cause movement of the strip into said first position to block the gap between the bottom edge of the door leaf and the threshold.

In practical embodiments of the invention it is envisaged that the strip-raising movement will be consequent upon a positive attraction of the magnetically-attractable piece to the magnet, as there is then a positive holding force acting on the strip throughout the time the door swings about its hinges. Although in theory a positive force of repulsion could push the strip upwards into the door and hold it there, it is surer as well as simpler to arrange for the strip to be positively attracted to the magnet when the door opens and then allowed to drop (or positively repulsed) and contact the threshold under gravity when the door is closed.

The magnetically attractable piece of material may conveniently comprise another magnet. Since opposite magnetic poles attract, and corresponding poles repel, the forces lifting and letting fall the strip of material can be made that much more positive using such components.

Preferably the bar or the strip of material (or both) carry more than one magnet, and such magnets are aligned and spaced so that the necessary forces of attraction and repulsion are produced depending on whether the door is open or closed.

In one embodiment of the invention the actuation means of the strip actuation member comprises one end of the bar which terminates adjacent the door upright or adjacent the threshold and positively projects from the edge of the door so as to contact, and effectively be "triggered" by, the upright or the threshold as the door closes and opens.

Alternatively or additionally this terminating end of the bar may be magnetically operated, ie may be positively attracted to or repulsed from a co-operating magnet in the door upright or the threshold as the door closes and opens.

In an alternative embodiment the actuation means comprises a cam which is rotatably mounted in the housing. One edge of the cam protrudes from the edge of the door and an end of the cam is pivotally attached to the elongate bar. When the cam contacts the upright or the threshold it is rotated to cause horizontal movement of the elongate bar.

Preferably the bar is spring-loaded in a way which assists its operation in raising the strip from the threshold.

The press means may comprise a surface of the threshold or upright, but to prevent wear there may be provided a plate mounted on the threshold or upright which contacts the actuation means when the door is closed.

The second attraction/repulsion element may be fixed on the strip of material.

The strip of material, whilst being held against any undue lengthwise movement in the door, may not be restricted in its up and down movement other than by its lengthwise constraints and the threshold which it contacts. In other words in this case the strip is free to "float" and effectively find its own level once it contacts the threshold.

Alternatively the movement of the strip of material may be restricted. The second attraction/repulsion element may be coupled to the strip by at least one lever member. Each lever member is pivotally attached to both the strip and the second attraction/repulsion element. Each lever member is rotatably mounted to the housing. The axis of rotation lying between the strip and the second attraction/repulsion element. In this way upwards movement of the second attraction/repulsion element causes downwards movement of the strip. Thus a much more controlled movement of the strip is produced.

Preferably two lever members extend between the strip and the second attraction/repulsion element.

The bar may conveniently comprise an elongate bar which, like the strip, extends essentially across the whole of the length of the bottom edge of the door leaf and with a substantially constant vertical gap between it and the top edge of the strip. This makes it possible for the bar and the strip to accommodate lines of multiple magnets for maximum effectiveness of operation.

It also makes it possible for the bar to ride in a continuous shelf of plastics or other suitable non-magnetic material, which shelf can separate the bar from the strip whilst not impeding the efficient operation of the magnet and the magnetically-attracted piece or pieces irrespective of whether such pieces comprise magnets themselves.

The strip of material may be a fire-resistant strip but it could simply be a draught excluder. As such it could be made of inherently flexible material consistent with the need for the mechanism to operate.

The bottom edge of the strip, the one that contacts the threshold when the door is closed, could be faced with rubber or other resilient material for a good draughtproof seal.

The door leaf and door frame could be found in situations other than internal or external access doors in buildings. For example, they could comprise the door of a food freezing cabinet.

If the strip of material were suitably waterproofed then the invention provides a potential means of blocking off flood water from external doors of buildings. In practice the water might eventually find its way through but nevertheless the very large amounts of debris which do as much if not more damage than the incoming flood water would be kept out by such a mechanism.

Two mechanisms embodying the invention are shown in the accompanying drawings and will now be described with reference to those drawings. The second mechanism is currently the best way known to the applicants of putting the invention into practice.

BRIEF DESCRIPTION OF THE DRAWINGS

FIG. 1 shows the bottom edge region of a first example of door leaf when viewed flat-on and with parts broken away to show the door blocking strip held clear of the threshold;

FIG. 2 corresponds to FIG. 1 but with the strip contacting the threshold;

FIG. 3 is an edge-on view of the door leaf sectioned to show the parts of the first mechanism;

DESCRIPTION OF THE PREFERRED EMBODIMENTS

Figure 4A:
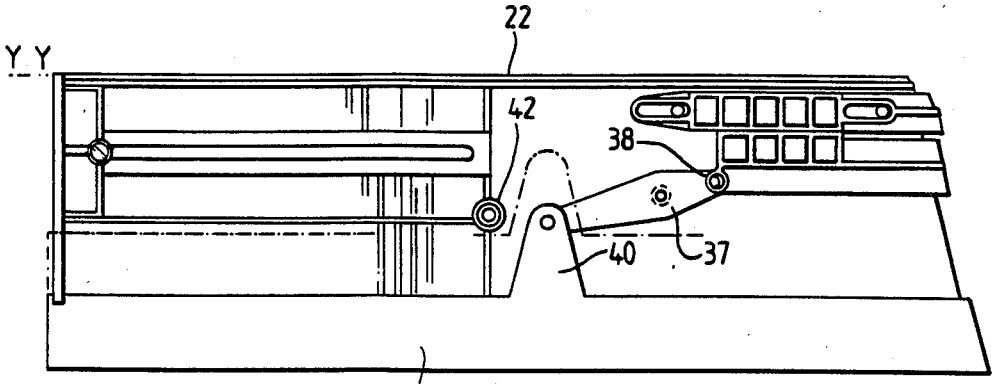
FIGS. 4A, B and C are views of the end, middle and other end bottom edge region of a second example of a door leaf when viewed flat-on with cover removed.

In FIGS. 1, 2 and 3 of the first embodiment, a rectangular door leaf is referenced 11 and is of conventional construction in all but its bottom face region. It is hung, in use, coventionally inside a door frame to swing open and closed above a threshold 12. The door frame itself can be conventional and is not shown in the drawings.

A channel is routed out along the bottom edge of the door leaf 11 and extends along substantially the whole of the length of the bottom edge. This channel 13 accommodates a housing comprising plastics extrusion 14 which is glued or forcefitted into the channel 13 before the door leaf 11 is hung.

As FIG. 3 shows, the extrusion 14 is essentially rectangular in cross section and is A-shaped when so viewed. The cross piece 15 of the A extends along the whole of the length of the extrusion and acts as a bearing surface on which an elongate bar 16 can slide axially back and forth. The portion of the extrusion below the cross piece 15 forms an open-ended channel in which a strip of material 17 can move up and down towards and away from the underside of the bar 16.

The underside of the bar 16 carries a first attraction/-repulsion element comprising a succession of magnets. The top edge of the strip 17 carries a second attraction/-repulsion element also comprising a similar succession of magnets. The strip 17 is held against anything other than up and down movement in the door leaf 11, by pins 18; but the bar 16 can slide back and forth axially so as to bring its magnets M respectively into and out of the effective range of attraction or repulsion of the other line of magnets M on the top edge of the strip 17.

In this case one end 16*a* of the bar 16 forms an actuation means and protrudes from the upright edge of the door leaf 11. It is chamfered to give a "lead-in" as illustrated. The other end of the bar 16 compresses a coiled spring 19 which is initially inserted into the extrusion 14 and held therein by a stud 21.

With the door open, as illustrated in FIG. 1, and the end 16*a* of the bar 16 protruding from the upright edge of the door leaf 11, the two lines of magnets positively attract one another and the strip 17 is raised and held clear of the threshold 12. In this particular embodiment the strip is retracted wholly into the bottom edge of the extrusion 14 and hence into the door leaf. Pressure from the expanded compression spring 19 keeps the bar 16 in the position illustrated in FIG. 1.

As the door closes, the chamfered lead-in on the protruding end 16*a* of the bar 16 contacts an upright (not illustrated) of the door frame; and the bar is pushed axially to the left when viewed as in FIGS. 1 and 2, against the action of spring 19. This movement, which continues as the door leaf 11 closes fully into its frame, moves the line of magnets on the bar 16 in such a way that instead of opposite magnetic poles being vertically in alignment, like magnetic poles are now aligned and positively repel one another.

As a consequence the strip 17 falls under gravity to contact the threshold 12.

When the door is subsequently opened, the compression spring 19 expands to push bar 16 back into its FIG. 1 position. The vertical gap between the two lines of magnets in the FIG. 2 position is sufficiently small, when the door opens, for the strip 17 to be pulled back up against the underside of shelf 15 due to the force of attraction between the two lines of magnets in the FIG. 1 position.

The opposite upright edges of the door leaf 11 will of course conventionally close inside their respective door frame uprights. For that reason it is not necessary for the strip 17 to extend literally the whole length of the bottom edge of the door leaf—as long as it at least reaches and preferably overlaps the two opposite door frame uprights.

Figure 4B:
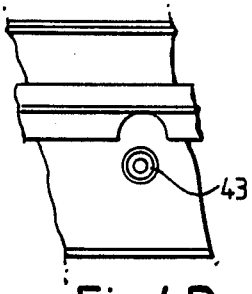
Figure 4C:
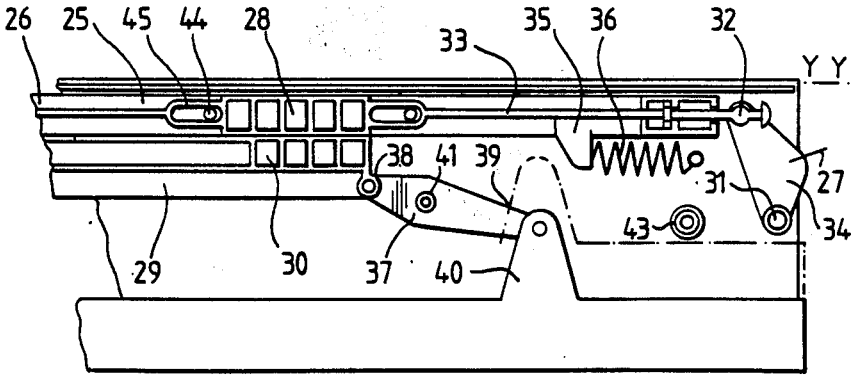
Figure 5A:
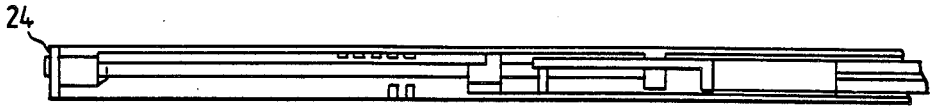
FIGS. 5A, B and C are sections through the Y—Y of FIGS. 4A, B and C.
Figure 5B:
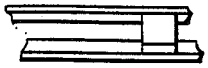
Figure 5C:
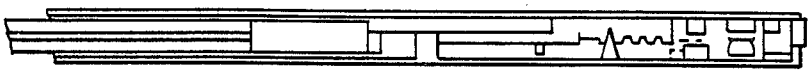

A second example of a mechanism in accordance with the invention is shown in FIGS. 4 and 5.

In this case a door leaf (not shown) is of conventional structure but has a rebate cut from the bottom edge of one of its faces. Into this rebate is placed the mechanism 22. An L-shaped cover is screwed into place over the mechanism (not shown) to protect the components of the mechanism.

A strip of material 23 has a length equal to the length of the elongate edge of the bottom face of the door leaf and is housed within a plastics housing indicated generally as 24.

A strip actuation member 25 is mounted within the housing 24 adjacent and parallel to the strip 23. The strip actuation member 25 comprises an elongate bar 26 and an actuation member 27. The actuation member 27 is mounted so that it is adjacent the upright of the door frame.

A first attraction/repulsion element comprises a series of magnets 28 mounted rigidly to the elongate bar 26. The elongate bar 26 has two series of magnets 28 mounted on it, one series being mounted at each of its ends. Each series comprises five magnets of alternating poles as shown in the first example.

A second attraction/repulsion element 29 comprises a bar having mounted upon it two sets of magnets, one at either end of the bar 29. Each set 30 has four magnets of alternating poles which experience both a positive attraction to the first magnets 28 in one position and a positive repulsion in a second position.

The cam 27 is rotatably mounted by pivot pin 31 to the housing 24. One end 32 is pivotally attached to bar 33 forming part of the elongate bar 26. One edge 34 of the cam is rotatable to a position where it protrudes from the edge of the door leaf. On closure of the door the cam 27 is pressed and, therefore, rotated to cause movement of the elongate bar 26 in a leftwards direction.

A projection 35 extends downwardly from the elongate bar 33 and is engaged by a spring 36 whose other end is attached to the housing 24. The spring 36 exerts a pulling force on the projection 35 to bias the bar 33 in a right-hand direction and therefore bias the cam 27 into a position where it protrudes from the door leaf when the door is open.

The second attraction/repulsion element 29 is coupled via two lever members 37 to restrict 23.

Each end 38 of the element 29 is pivotally attached to an end of the lever member 37. The other end of 39 of the lever member 37 is pivotally attached to a projection 40 from the strip 23. The lever member 37 is rotatably mounted between the pivotal attachments 38 and 39 at 41 to the housing. Thus, the second attraction/-repulsion element 29 is free to move in a vertical plane only and movement in one direction of the attraction/-repulsion element 29 will cause equal and opposite movement of the strip 23. Three stops 42, 43 and 44 are provided along the length of the housing to limit the upwards movement of the strip 23. The downwards movement of the strip 23 is limited by the contact of the magnets 30 on the set of magnets 28 of the first attraction/repulsion element. Clearly at this point, the blade 23 will be at its lower most position where it will block any gap between the edge of the door leaf and the threshold completely.

Thus, as the door is closed the cam member 27 is rotated inwardly to push the elongate bar 26 leftwards to its limit position as shown in solid lines in FIGS. 4A to 4C. At this point the magnets 28 and 30 attract each other and the second attraction/repulsion element 29 is held at its upper most position so that the blade 23 is held at its lower most position to block the gap between the door and the threshold.

When the door is opened again, the spring 36 urges the elongate rods 33 and 26 to move in a rightwards direction and the cam 27 is not now engaged by an upright of the door frame and so can rotate outwards allowing the reaction between the two attraction/repulsion elements to change to that of repulsion to push the second attraction/repulsion element 29 downwards, thus pulling the blade 23 upwards to a position where it clears the ground and allows the door to swing open freely.

The sliding movement of the elongate bar 26 is limited by pin 44 which projects into slots 45 along the length of the bar.

Figure 6:
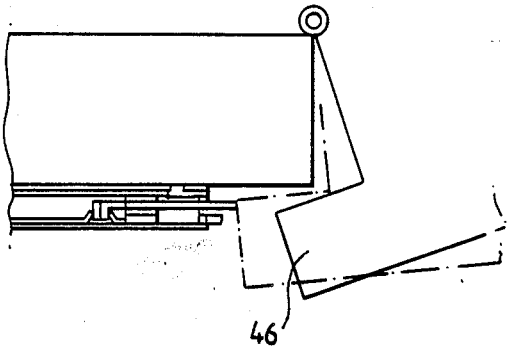
FIG. 6 is a schematic view of an end of a door leaf closing.

Thus can be seen in FIG. 6 the actuation means being either the end of the bar or a separate cam member may be actuated by pressing onto a press region 46 which just comprises the surface of the door frame.

We claim:

1. A mechanism for attachment to a door leaf, hung within a surrounding frame to open and close an adjacent threshold, the door leaf having a bottom face having an elongate edge and a short end edge; a gap being defined between the bottom face of the door leaf and the surrounding frame when the door is closed; the mechanism for automatically blocking said gap when the door is closed; and automatically unblocking said gap when the door subsequently starts to open; the mechanism comprising:

(a) a strip of material having a length essentially equal to the length of the elongate edge of the bottom face of the door leaf;

(b) housing means housing said strip in the region of the bottom face of the door leaf to extend along the elongate edge of the door leaf;

(c) means mounting said strip within said housing means for movement up and down from a first position (in which said strip protrudes from the bottom face of the door leaf to contact the threshold); into and out of a second position (in which it is held clear of the threshold);

(d) a strip actuation member including an elongate bar and actuation means;

(e) means mounting said elongate bar within said strip housing means to extend adjacent said strip, for movement back and forth along a horizontal axis;

(f) means mounting said actuation means adjacent one of the threshold and an upright of the door frame, for movement between a first and second position;

(g) a first attraction/repulsion element;

(h) a second attraction/repulsion element;

(i) one of said attraction/repulsion elements comprising at least one magnet; and the other of said attraction/repulsion elements comprising at least one piece of material having a positive reaction of one of attraction or repulsion to the magnet;

(j) means fixing said first attraction/repulsion element on said elongate bar;

(k) means mounting said second attraction/repulsion element within said housing means for movement up and down, in the vicinity of the first attraction/-repulsion element;

(l) means operatively coupling said second attraction/repulsion element to said strip whereby movement in the vertical direction of the second attraction/repulsion element causes movement in the vertical direction of said strip;

(m) press means;

(n) means mounting said press means to one of the threshold and an upright of the door frame to cooperate with said actuation means, whereby to move said actuation means from second position when the door is open to a first position when the door is closed; and, (o) means connecting said actuation means to said elongate bar whereby movement of said actuation means causes movement along said axis of said elongate bar and said first attraction/repulsion element with respect to said second attraction/-repulsion element;

the arrangement whereby the first attraction/repulsion element is moved from a position in which it is within the range of the second attraction/repulsion element and said positive reaction between said magnet and said piece of material occurs to a position where the first attraction/repulsion element is out of the range of the second attraction/repulsion element and said reaction is absent; whereby on closure of said door, said actuation means moves to said first position to move said elongate bar to move the first attraction/repulsion element with respect to the second attraction/repulsion element to cause vertical movement of the second attraction/-repulsion movement to cause movement of the strip into said first position to block the gap between the bottom edge of the door leaf and the threshold.

2. The mechanism of claim 1, wherein the piece of material comprising said other of said attraction/repulsion element comprises at least one magnet.

3. The mechanism of claim 1, wherein said one of said attraction/repulsion elements comprises a plurality of magnets, the mechanism also including means mounting each of said plurality of magnets in the vicinity of a piece of material of said other attraction/repulsion element.

4. The mechanism of claim 1, wherein said actuation means of said strip actuation member comprises an end of said elongate bar; the means mounting said bar within the housing mounting the bar for movement between a second position where said end protrudes from the end edge of the door and a first position wherein said end does not protrude from the end edge of the door.

5. The mechanism of claim 1, wherein said actuation means comprises a cam, and means rotatably mounting said cam with respect to said housing; the means operatively coupling said actuation means to said elongate bar comprising a pivotal attachment between said actuation means and said elongate bar; the pivotal attachment being spaced from the rotatable mounting means; the cam extending from the rotatable mounting means away from the said pivotal attachment to protrude from said door edge, whereby on closure of the door, said press means contacts said cam to rotate said cam and cause movement along said axis of the bar.

6. The mechanism of claim 1, also comprising spring biasing means; and means mounting said spring biasing means between said elongate bar and said housing to bias the bar into one position.

7. The mechanism of claim 1, wherein said means operatively coupling said second attraction/repulsion element to said strip fixes said second attraction/repulsion element to said strip whereby upwards and downwards movement of said second attraction/repulsion element causes respective upwards and downwards movement of said strip.

8. The mechanism of claim 1, wherein said means operatively coupling said second attraction/repulsion element to said strip comprises:

at least one lever member;

for each lever member, means rotatably mounting said lever member with respect to said housing;

means pivotally attaching one end of said lever member to said second attraction/repulsion element;

means pivotally attaching the opposite end of said lever member to said strip; whereby movement upwards and downwards of said second attraction/repulsion element rotates said lever members to cause respective downwards and upwards movement of said strip.

9. The mechanism of claim 1, wherein said strip is a fire resistant strip.

10. The mechanism of claim 1, wherein said strip also includes a resilient draught proofing material and means facing said bottom edge of the strip with said resilient draught proofing material.

11. A mechanism for attachment to a door leaf, hung within a surrounding frame to open and close an adjacent threshold, the door leaf having a bottom face having an elongate edge and a short end edge; and gap being defined between the bottom face of the door leaf and the surrounding frame when the door is closed; the mechanism for automatically blocking said gap when the door is closed; and automatically unblocking said gap when the door subsequently starts to open; the mechanism comprising:

(a) a strip of material having a length essentially equal to the length of the elongate edge of the bottom face of the door leaf;

(b) housing means housing said strip in the region of the bottom face of the door leaf to extend along the elongate edge of the door leaf;

(c) means mounting said strip within said housing means for movement up and down from a first position (in which said strip protrudes from the bottom face of the door leaf to contact the threshold) into and out of a second position (in which it is held clear of the threshold);

(d) an elongate bar;

(e) means mounting said elongate bar within said housing means to extend adjacent said strip, for movement back and forth along a horizontal axis;

(f) a cam;

(g) means rotatably mounting said cam with respect to said housing, adjacent one of the threshold and an upright of the door frame for rotatable movement between a first and second position;

(h) means pivotally attaching said elongate bar to said cam, the pivotal attachment being spaced at least horizontally from the rotatable mounting means; the cam extending from the rotatable mounting means away from the pivotal attachment to protrude from the door edge;

(i) a first attraction/repulsion element;

(j) a second attraction/repulsion element;

(k) one of said attraction/repulsion elements comprising at least one magnet; and the other of said attraction/repulsion elements comprising at least one piece of material having a positive reaction of one of attraction or repulsion to the magnet;

(l) means fixing said first attraction/repulsion element on said elongate bar;

(m) means mounting said second attraction/repulsion element within said housing means for movement up and down in the vicinity of the first attraction/-repulsion element;

(n) at least one lever member; for each lever member, (o) means rotatably mounting said lever member with respect to said housing;

(p) means pivotally attaching one end of said lever member to second attraction/repulsion element;

(q) means pivotally attaching opposite end of said lever member to said strip, whereby movement upwards and downwards of said second attraction/repulsion element rotates said lever members to cause respective downwards and upwards movement of said strip;

(r) press means;

(s) means mounting said press means to one of the threshold and an upright of the door frame to cooperate with said cam whereby to rotate said cam from a second position when the door is open, the arrangement whereby the first attraction/repulsion element is movable from a position in which it is within the range of the second attraction/repulsion element and said positive reaction between said magnet and said piece of material occurs to a position where the first attraction/repulsion element is out of the range of the second attraction/repulsion element and said reaction is absent; whereby on closure of said door said press means rotates the cam to move said elongate bar to move the first attraction/repulsion element with respect to said second attraction/repulsion element to cause upwards movement of said second attraction/repulsion element to rotate said lever members to cause downwards movement of said strip into said first position where it blocks the gap between the edge of the door leaf and the threshold.

* * * * *